United States Patent [19]

Hasegawa et al.

[11] Patent Number: 4,967,209

[45] Date of Patent: Oct. 30, 1990

[54] RECOVERY DEVICE FOR AN INK JET PRINTER

[75] Inventors: Takeshi Hasegawa, Yokohama; Akihiko Kobayashi, Mitaka, both of Japan

[73] Assignee: Canon Kabushiki Kaisha, Tokyo, Japan

[21] Appl. No.: 187,987

[22] Filed: Apr. 29, 1988

[30] Foreign Application Priority Data

May 6, 1987 [JP] Japan ..... 62-108884

[51] Int. Cl.[5] ..... B41J 2/165

[52] U.S. Cl. ..... 346/140 R

[58] Field of Search ..... 346/140; 222/95

[56] References Cited

U.S. PATENT DOCUMENTS 4,306,245 12/1981 Kasugayama ..... 346/140
4,599,625 7/1986 Terasawa ..... 346/140

FOREIGN PATENT DOCUMENTS 224550 8/1985 Japan .
60-204362 10/1985 Japan .

OTHER PUBLICATIONS

Patents Abstracts of Japan, Mar. 5, 1986, vol. 10, No. 5.

*Primary Examiner*—Joseph W. Hartary

[57] ABSTRACT

A recovery device for an ink jet printer is disclosed that is used to perform discharge recovery on an ink jet recording head when the discharge port of the recording head is blocked. The recovery device of the present invention includes a pressing member that is used during the discharge recovery procedure to press on an ink chamber contained within the recording head. The pressure being applied to the ink chamber causes the ink within the chamber to be discharged from the discharge port of the recording head. The pressing member can be moved between (i) a recovery position wherein it extends from a receiving surface of the recovery device in an orientation such that it can be used to press against the ink chamber during a discharge recovery operation and (ii) a retracted position wherein it is received by the receiving surface when not performing the discharge recovery operation.

7 Claims, 8 Drawing Sheets

RECOVERY DEVICE FOR AN INK JET PRINTER

BACKGROUND OF THE INVENTION

1. Field of the Invention

This invention relates to a recovery device used for recovery from unsatisfactory ink discharge of an ink jet recording head, an ink jet printer provided with the recovery device, and an electronic desk calculator provided with the printer.

2. Related Background Art

In an ink jet printer provided with an ink jet recording head, supply of ink from an ink chamber storing the ink therein to a discharge port for discharging the ink therethrough is accomplished mostly by the utilization of capillary phenomenon. Therefore, if air remains in the ink chamber and/or an ink passageway and bubbles are created, supply of the ink to the discharge port cannot be smoothly accomplished, and this may sometimes bring about an inconvenience for the ink discharge from the discharge port.

The entry of bubbles into the recording head is particularly remarkable, for example, during the filling of the ink chamber of the recording head with ink, or during the mounting of the recording head in a case where the recording being used is of the cartridge type, or when vibrations are imparted to the printer or the printer falls and is shocked.

So, when the entry of bubbles into the recording head has occurred, it is necessary to remove such bubbles from the recording head to provide a good ink discharge condition.

Also, in the ink jet recording head, it is sometimes the case that the solvent of the ink evaporates at the ink discharge port to create solidities adhering to the discharge port of bubbles and foreign materials such as dust clog the liquid path to cause unsatisfactory ink discharge including non-discharge of ink.

As a method for recovering from such unsatisfactory ink discharge, there is generally adopted, for example, a method of pressing the ink chamber with the discharge port facing upward and forcing the solidities adhering to the discharge port and the foreign materials in the liquid path out of the discharge port, etc. to thereby remove them.

For example, in a prior-art ink jet printer 611 carried on an electronic desk calculator as shown in FIGS. 1A and 1B of the accompanying drawings, a recording head 612 is formed with a small hole (a pressing small hole) 612*a* used to access an ink reservoir bag member (within which an ink chamber is formed) in the recording head, and a pressing needle 613 may be inserted into the small hole 612*a* to thereby press the ink reservoir bag member.

That is, means for recovery from unsatisfactory ink discharge in such apparatus comprises a flange-like portion (a cradle) 601*a* horizontally protruding from an upper cover 601 and formed with a recess 601*e*, and an upright pressing needle 613 having its lower end fixed to the center of the bottom of the recess 601*e*.

To perform the operation of recovering from the unsatisfactory ink discharge of the recording head as described above, the recording head 612 is first detached from the printer and that portion thereof in which the pressing small hole 612*a* is formed is gradually fitted into the recess 601*e*. Thereupon, the recording head 612 assumes its upright state with the discharge port (not shown) facing upward, and the pressing needle 613 provided in the recess 601*e* is gradually inserted into the pressing small hole 612*a* in the recording head 612. As the pressing needle 613 is further inserted upward, the ink reservoir bag member (the ink chamber) in the recording head 612 is gradually pressed and the ink is forced up toward the discharge port by the pressure, and the foreign materials, with the ink, are removed from the discharge port. This operation is continued, for example, until the moment when the ink leaks out of the discharge port.

Finally, when the ink has come to leak out of the discharge port, the recording head 612 is raised up and the pressing needle 613 is withdrawn from the pressing small hole 612*a*, and the recording head 612 is held raised up for a while (so that the leaking ink may not drip). Thereupon, the ink which has leaked out onto the recording head 612 is gradually absorbed from the discharge port into the ink reservoir bag member due to the elastic force of restitution of the ink reservoir bag member.

When the absorption of the ink is completed, the surface tension of the ink in the discharge port portion becomes balanced with the negative pressure in the ink reservoir bag member and therefore, no air enters thereinto and the recording head becomes ready for normal use.

After the operation of recovery from unsatisfactory ink discharge is completed in the manner described above, an ink cartridge is set in the printer.

In the above-described prior-art printer, however, it is necessary that the size and shape of the flange-like portion 601*a* and the location at which it is installed be set so that a sufficient space for accommodating that portion of the recording head in which the pressing small hole 612*a* is formed may be provided in the recess 601*e* in which the pressing needle 613 is provided and moreover, during the pressing of the ink chamber, an effective operation of recovery from unsatisfactory ink discharge may be accomplished with the recording head remaining upright, for example, so that when any ink leaks out of the discharge port, it will not go into the printer.

However, such reguirements in the design of the flange-like portion 601*a* are great limitations on the compactness and design of the printer itself, and they are problems that need to be solved for such printer to be carried on various types of instruments such as more compact electronic desk calculators or instruments which are higher in function and fashionableness.

Moreover, the pressing needle 613 is always upright and therefore, meticulous care must be taken so as not to break the pressing needle 613 when handling the printer and thus, there has been the problem that hindrances sometimes occur to the operability of the printer.

SUMMARY OF THE INVENTION

It is an object of the present invention to provide a device for recovery from unsatisfactory ink discharge of an ink jet recording head which poses no limitation in the compactness and design of an ink jet printer, an ink jet printer provided with the recovery device, and an electronic desk calculator provided with the printer.

It is another object of the present invention to provide device for recovering from unsatisfactory ink discharge of an ink jet recording head which does not adversely affect the operability of an ink jet printer, an ink jet printer provided with the recovery device, and an electronic desk calculator provided with the printer.

It is still another object of the present invention to provide an ink jet printer having an ink jet recording head having an ink chamber for storing therein ink to be supplied to a discharge port for discharging ink therethrough, and recovery means having a pressing member for pressing said ink chamber, said pressing member being capable of being contained in the body of a printer.

It is yet still another object of the present invention to provide a recovery device for an ink jet recording head having a pressing member for pressing the ink chamber of the ink jet recording head having an ink chamber for storing therein ink to be supplied to a discharge port for discharging ink therethrough, said pressing member being capable of being contained in the body of a printer.

DETAILED DESCRIPTION OF THE PREFERRED EMBODIMENTS

In the printer of the present invention, a pressing needle used for the operation of recovery from unsatisfactory ink discharge of the recording head can be received in a cradle except during use and therefore, the space occupied by means for recovery from unsatisfactory ink discharge is greatly saved and the degree of freedom with which such recovery means is installed is increased and thus, the limitations in the compactness and designing of the printer by the means for recovery from unsatisfactory ink discharge as experienced in the prior-art printer can be eliminated.

Some embodiments of the present invention will hereinafter be described in detail with reference to the drawings.

Figures 1A, 1B:
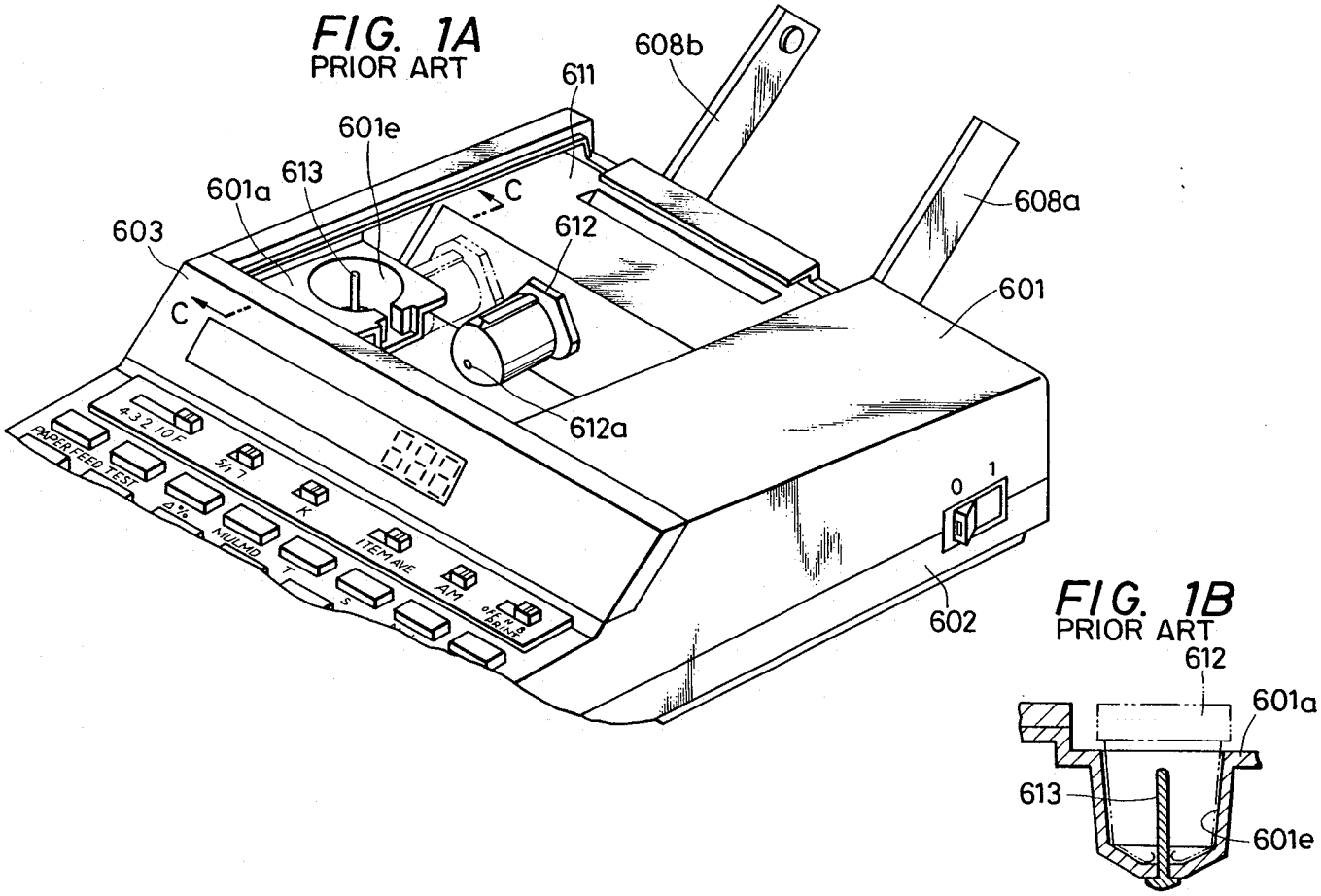
FIG. 1A PRIOR ART
FIG. 1B PRIOR ART
FIG. 1A is a schematic perspective view showing an example of the prior-art ink jet printer as carried on an electronic desk calculator.
FIG. 1B is a schematic enlarged cross-sectional view along the line C—C of FIG. 1A.
Figure 2A:
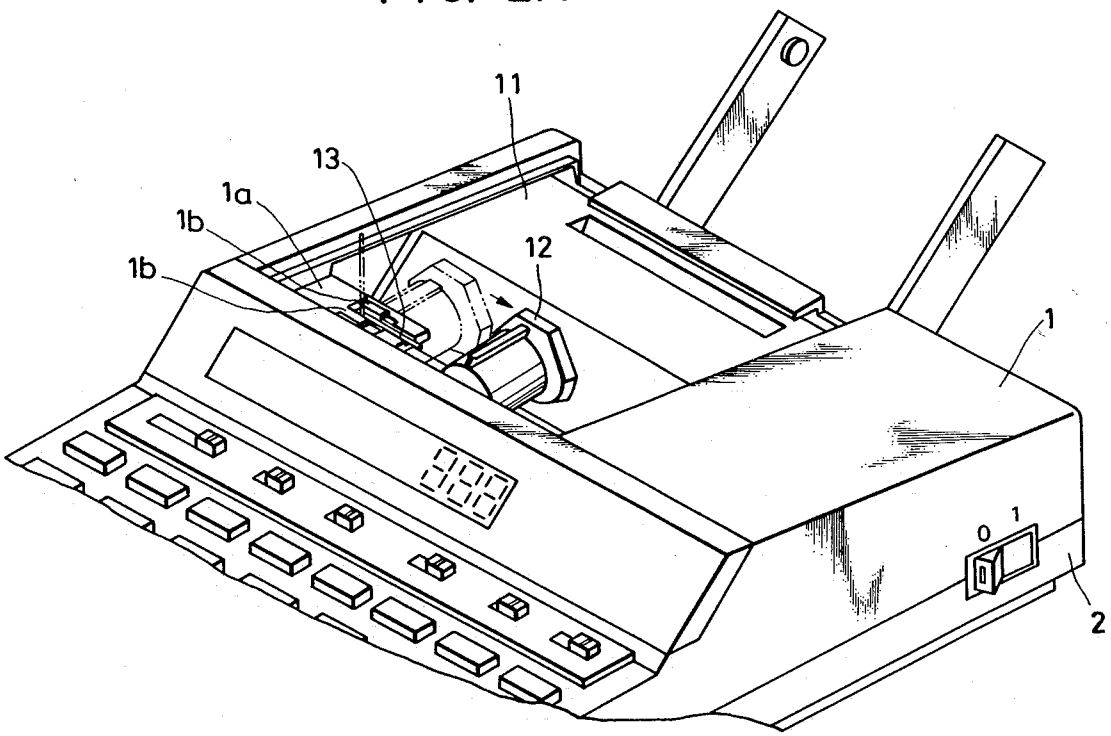
FIGS. 2A and 2B are schematic perspective views showing an embodiment of the ink jet printer of the present invention as carried on an electronic desk calculator, FIG. 2A showing a state in which a printer lid is removed, and FIG. 2B showing a state in which the printer lid is attached to the printer.
Figure 2B:
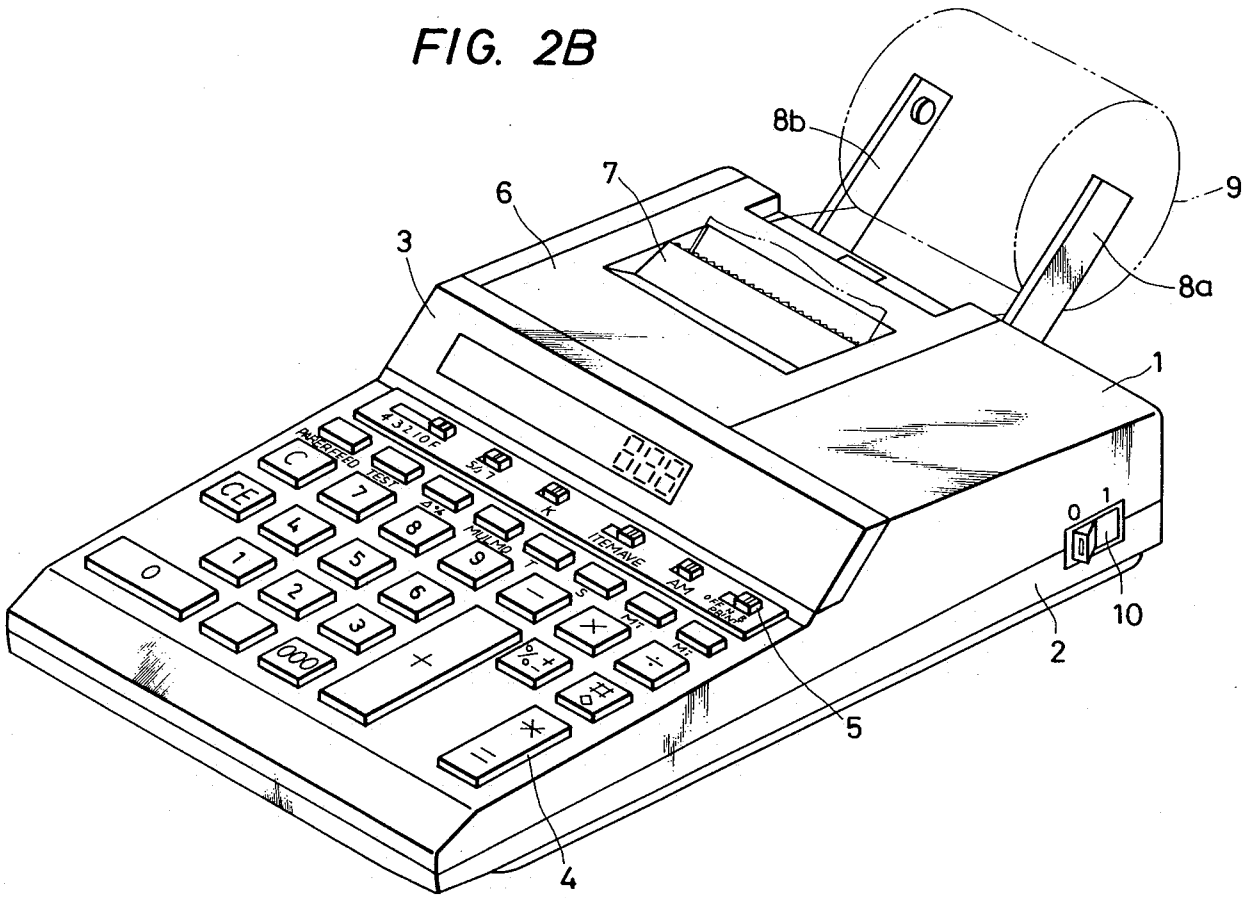

FIGS. 2A and 2B are schematic perspective views showing the essential portions of an embodiment in which the ink jet printer of the present invention is carried out on an electronic desk calculator. FIG. 2A shows a state in which a printer lid for opening and closing a recording head containing portion with respect to the outside is removed, and FIG. 2B shows a state in which the printer lid is attached to the printer.

In this embodiment, the printer body 11 is held between an upper cover 1 and a lower cover 2, and has a recording head 12 placed on a carriage to effect printing while being moved in opposed relationship with printing paper (not shown).

The upper cover 1 is provided with a flange-like portion (a cradle) **1*a* rising out to the upper part of the containing portion for the printer 11 in parallelism to the bottom of the instrument body, and a groove for containing the pressing needle therein and two restraining pawls 1*b* covering a part thereof are formed in the upper surface portion of the flange-like portion 1*a***.

The aforementioned pressing needle 13 which is a pressing member used for the operation of recovery from unsatisfactory ink discharge is provided on the flange-like portion **1*a***.

Figure 3A:
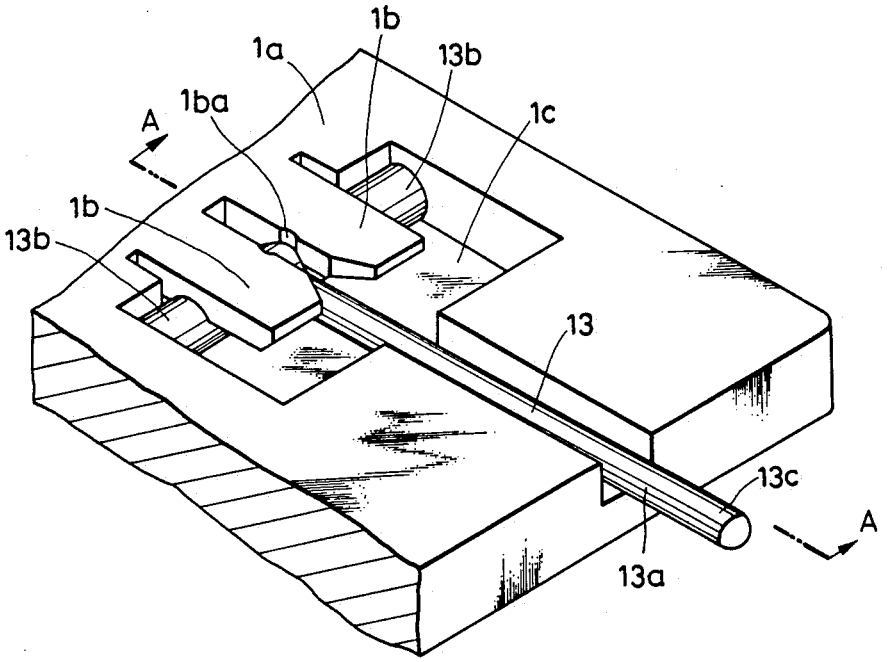
FIG. 3A is a schematic enlarged perspective view of the essential portions of the ink jet printer of the present invention.
Figure 3B:
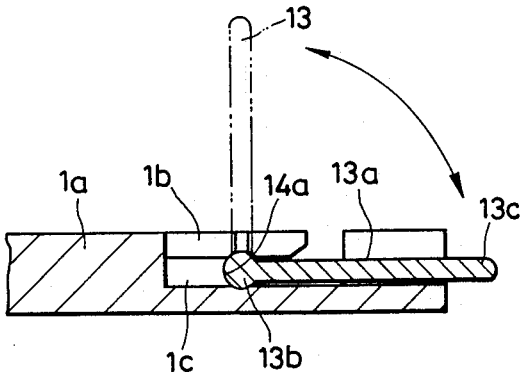
FIG. 3B is a schematic enlarged cross-sectional view along the line A—A of FIG. 3A.

The pressing needle 13, as shown for example in FIGS. 3A and 3B (FIG. 3A being a schematic enlarged perspective view of the essential portions of the flange-like portion **1*a* and FIG. 3B being a schematic enlarged cross-sectional view along the line A—A of FIG. 3A), is of an inverted T-bar shape having a protruding portion (a holding portion) 13*b* orthogonal to the needle body 13*a*, and is rotatably held by the holding portion 13*b* in the containing groove 1*c* for the pressing needle 13 and between the two restraining pawls 1*b* and the bottom of the containing groove 1*c***.

The tip end portion **13*c* of the pressing needle 13, when in its contained or retracted state, is disposed so as to slightly protrude from the flange-like portion 1*a*** and is designed to be capable of being caught by a user's fingers when it is to be erected or extended for use.

The shape of the containing groove **1*c* and the positional relation thereof with the restraining pawls 1*b* are so set that the holding portion 13*b* is removably mountable between the restraining pawls 1*b* and the bottom of the containing groove 1*c*, and the pressing needle 13 can be removably mounted into the groove 1*c*** as required, or can be replaced with another pressing needle.

A recess corresponding in shape to the holding portion **13*b* is formed in that portion of the underside of the restraining pawls 1*b* against which the holding portion 13*b* bears, and by virtue of this recess, the holding portion 13*b* is stably held between the restraining pawls 1*b* and the bottom of the groove 1*c* without moving unduly within the groove 1*c***.

The flange **1*a* functions as a cradle for a recording head 21 during the containment of the pressing needle 13 and the operation of recovery from unsatisfactory ink discharge, and if it has such a function, the configuration thereof is not limited as described above. Also, by making the flange-like portion 1*a* wide as shown, it can be made to function as a saucer for receiving any ink which may leak from the discharge port of the recording head 12 during the operation of recovery from unsatisfactory ink discharge, or for preventing fragments of the pressing needle 13 when damaged from entering into the instrument, and whether such a function is added to the flange-like portion can be selected in conformity with the position at which the pressing needle 13** is provided.

Further, in this embodiment, the flange-like portion 1*a* is provided as protruding from the upper cover 1, but alternatively may be provided at other suitable locations on the upper cover 1 or the lower cover 2, or a suitable planar surface of a member constituting the instrument may be utilized as the flange-like portion 1*a* and a groove for containing the pressing needle may be directly formed therein.

The pressing needle 13, during its non-use, is contained in the containing groove 1*c* while being brought down or retracted, and during its use, it is in its extended state with its head first cocked up with the point of intersection between its body 13*a* and holding portion 13*b* as a fulcrum.

To press the ink reservoir bag member of the ink jet recording head 12 and perform the operation of recovery from unsatisfactory ink discharge as previously described, the recording head 12 is first removed from the carriage. Subsequently, the pressing needle 13 which is being contained is extended through the procedures as shown in the schematic top plan views of FIGS. 4A–4D.

Figure 4A:
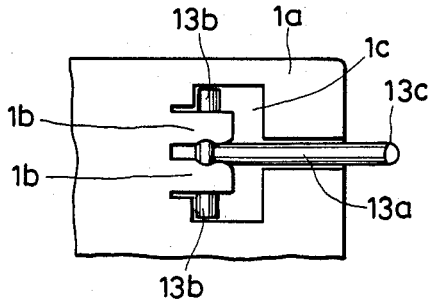
FIGS. 4A–4D are schematic top plan views showing the process of cocking up or extending a pressing needle.
Figure 4B:
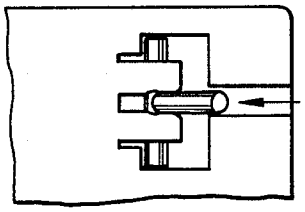

That is, the head 13*c* of the pressing needle 13 being contained as shown in FIG. 4A is caught by the user's fingers or the like and extended. At this time, the pressing needle 13 is extended while its holding portion 13*b* is rotating. The two restraining pawls 1*b* are formed with portions having a spacing between each other that is somewhat narrower than the diameter of the pressing needle body 13*a* and therefore, the pressing needle 13 first bears against those portions (FIG. 4B).

Figure 4C:
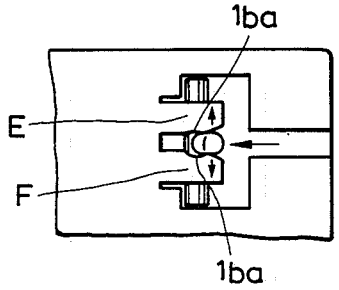
Figure 4D:
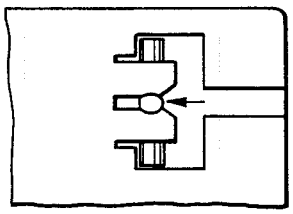

When a further force is applied to the pressing needle 13, the pressing needle 13 advances while opening the two restraining pawls 1*b* in the directions of arrows E and F indicated in FIG. 4C, and finally, as shown in FIG. 4D, it is smoothly forced into recesses 1*ba* corresponding to the diameter of the pressing needle 13 which are provided at the locations on the two restraining pawls 1*b* whereat the pressing needle 13 is extended, with the aid of the force of restitution with which the opened two restraining pawls 1*b* restore their initial positions, and assumes a stable extended position.

Figure 5:
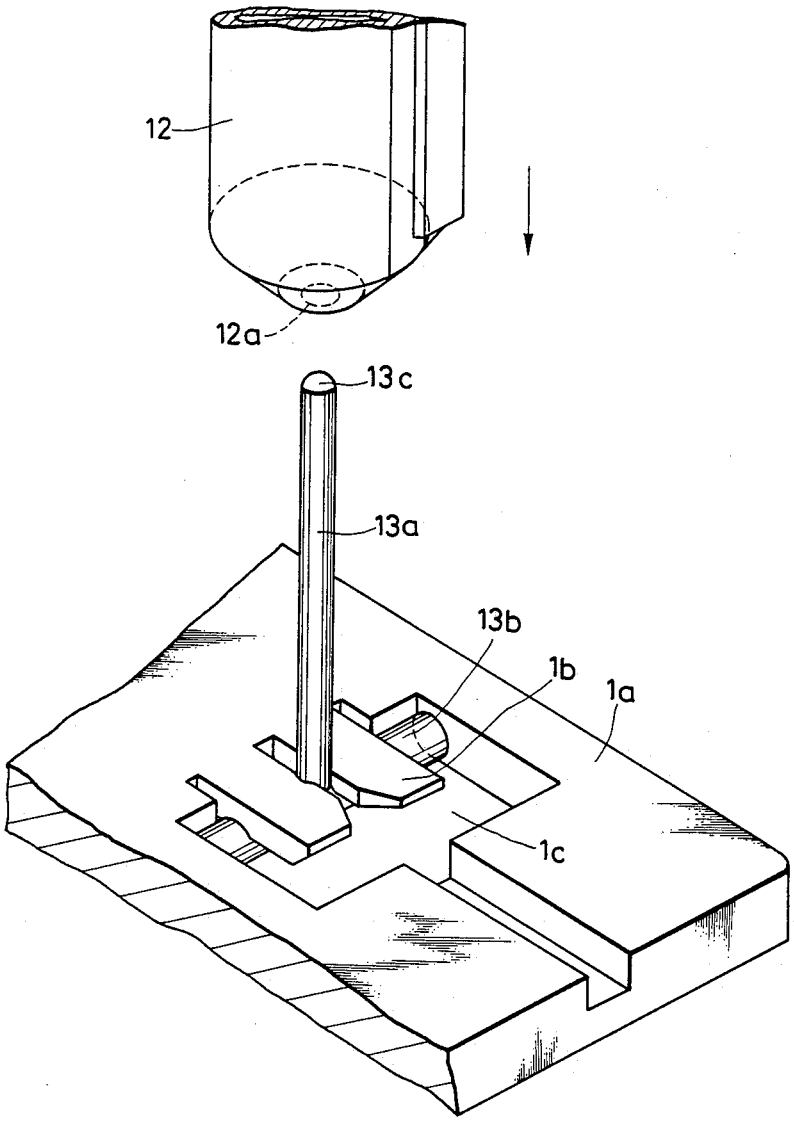
FIG. 5 is a schematic perspective view for illustrating the operation of removing bubbles in the ink jet printer of the present invention.

Subsequently, the thus extended pressing needle 13 is inserted into a pressing small hole 12*a* in the earlier removed recording head 12, as shown in FIG. 5, and the operation of recovery from unsatisfactory ink discharge is performed in accordance with the procedures as previously described.

While an embodiment of the present invention has been described above, the present invention is not restricted thereto, but may assume various modes of embodiment.

Figure 6A:
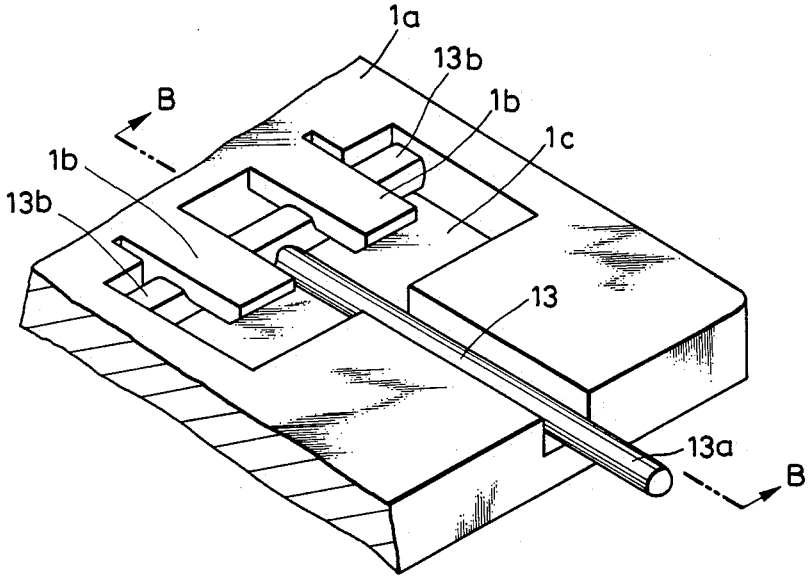
FIGS. 6A and 6B are schematic views showing another embodiment of the portion of the ink jet printer of the present invention in which the pressing needle is installed, FIG. 5A being a schematic perspective view, and FIG. 6B being a schematic enlarged cross-sectional view along the line B—B of FIG. 6A.
Figure 6B:
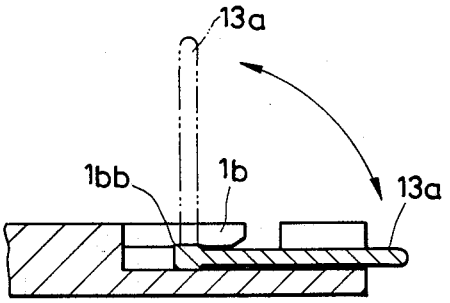

For example, as shown in FIGS. 6A and 6B, a recess 1*bb* of a polygonal cross-sectional shape such as a square, and corresponding in shape to those portions of the holding portion 13*b* which bear against the restraining pawls 1*b* when the pressing needle 13 is retracted and when the pressing needle 13 is extended may be provided in the underside of each restraining pawl 1*b*, and further the spacing between the two restraining pawls 1*b* is set to a value greater than the diameter of the pressing needle 13. Thus, the stable holding of the pressing needle 13 between the restraining pawls 1*b* and the bottom of the groove 1*c* becomes possible only when the pressing needle 13 is extended (broker line) and when the pressing needle 13 is retracted (solid line), and the extending of the pressing needle 13 and the operation of letting the pressing needle 13 be retracted can be rhythmically accomplished with moderate click and with good operability.

The shape of the pressing needle is not limited to an inverted T-bar shape, but may be suitably selected, for example, in accordance with the configuration of the recording head to be treated if the pressing needle can be contained in the groove during its nonuse and has a shape necessary for performing the operation of recovery from unsatisfactory ink discharge.

Figure 7A:
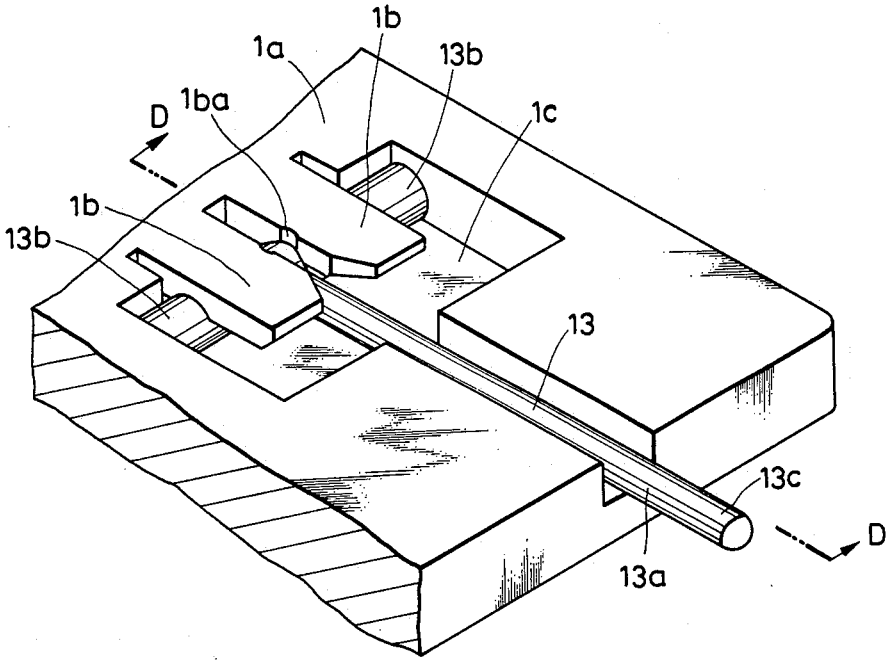
FIGS. 7A and 7B are schematic views showing the essential portions of an ink jet printer according to still another embodiment of the present invention, FIG. 7A being a schematic enlarged perspective view, and FIG. 7B being a schematic enlarged cross-sectional view along the line D—D of FIG. 7A.
Figure 7B:
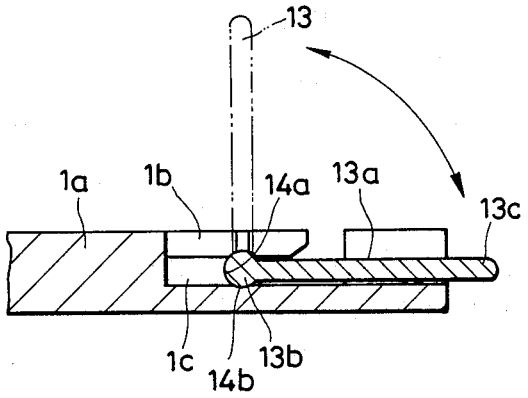

FIGS. 7A and 7B are schematic views showing the essential portions of an ink jet printer according to still another embodiment of the present invention. FIG. 7A is a schematic enlarged perspective view, and FIG. 7B is a schematic enlarged cross-sectional view along the line D—D of FIG. 7A.

This embodiment differs from the embodiment shown in FIG. 3 in that electrodes 14*a* and 14*b* are provided on the bottom of the pressing needle 13 and the wall of the containing groove, respectively, and detecting means (not shown) for detecting the contact between those electrodes 14*a* and 14*b* is further provided. In the present embodiment, the electrodes 14*a* and 14*b* are designed to contact each other when the pressing needle 13 is in its extended state as shown in FIG. 7B. Further, in the present embodiment, when said contact is detected by said detecting means, the ink jet recording head is stopped from operating. In such an embodiment, recording can be prevented from being effected with the pressing needle remaining extended and therefore, the ease with which the ink jet printer can be further improved.

In the embodiments described above, the pressing needle can be extended and retracted down so that the pressing needle can be contained in the printer body, but the present invention is not restricted thereto. For example, the pressing needle may be designed to be insertable into the printer body while remaining extended so that the pressing needle can be contained in the printer body.

In the printer of the present invention, the pressing needle used for the recovery from the unsatisfactory ink discharge of the recording head is designed to be capable of being contained in the cradle except during recovery, whereby the space occupied by the means for recovery from unsatisfactory ink discharge can be greatly saved and the degree of freedom with which such means is located is increased, and the limitations in the compactness and design of the printer caused by the means for recovery from unsatisfactory ink discharge that have been problematic in the prior-art printer can be eliminated.

We claim:

1. An ink jet printer having a printer body, the printer comprising:

a mounting section for detachably mounting to the printer an ink jet recording head having an ink chamber with a deformable bladder for storing ink to be supplied to a discharge port for discharging ink therethrough;

recovery means on said printer body, said recovery means including a receiving surface and a pressing member for pressing said ink chamber, said pressing member being movable between (i) a recovery position in which said pressing member extends from said receiving surface in an orientation wherein said pressing member can be used to press said ink chamber and eject ink from said discharge port to perform a discharge recovery operation and (ii) a retracted position in which said pressing member is received by said receiving surface when not performing said discharge recovery operation, wherein said recovery means has a groove for containing said pressing member therein, and said groove is defined by a cradle of said ink jet recording head and restraining pawls connected to said cradle for restraining a portion of said pressing member.

2. A recovery device for an ink jet recording head, comprising:

a receiving surface; and a pressing member for pressing an ink chamber of the ink jet recording head, said ink chamber having a deformable bladder for storing ink to be supplied to a discharge port for discharging ink therethrough, said pressing member being movable between (i) a recovery position in which said pressing member extends from receiving surface in an orientation wherein said pressing member can be used to press said ink chamber and eject ink from said discharge port to perform a discharge recovery operation and (ii) a retracted position in which said pressing member is received by said receiving surface when not performing said discharge recovery operation, wherein said recovery device includes a groove for containing said pressing member therein and, wherein said groove is defined by the cradle of said ink jet recording head and restraining pawls connected to said cradle for restraining a portion of said pressing member.

3. An ink jet printer having a printer body comprising:

a containing section for detachably containing an ink jet recording head having an ink chamber with a deformable bladder for storing ink supplied to a discharge port for discharging ink therethrough; and recovery means on said printer body, said recovery means including a receiving surface, a pressing member for pressing said ink chamber, said pressing member being moveable between (i) a recovery position in which said pressing member extends from said receiving surface in an orientation wherein said pressing member can be used to press said ink chamber and eject ink from said discharge port to perform a discharge recovery operation and (ii) a retracted position in which said pressing member is received by said receiving surface when not performing said discharge recovery operation and a pair of engaging members for regulating the recovery position and the retracted position of said pressing member, wherein said pair of engaging members are provided on a path between said recovery position and said retracted position of said pressing member and comprise elastically deformable members which are separated from each other by a space narrower than a diameter of said pressing member, deform as said pressing member passes therethrough, and maintain and fix said pressing member upright at said recovery position.

4. An ink jet printer having a printer body, the printer comprising:

a mounting section for detachably mounting to the printer an ink jet recording head having an ink chamber with a deformable bladder for storing ink to be supplied to a discharge port for discharging ink therethrough;

recovery means on said printer body, said recovery means including a receiving surface and a pressing member for pressing said ink chamber, said pressing member being movable between (i) a recovery position in which said pressing member extends from said receiving surface in an orientation wherein said pressing member can be used to press said ink chamber and eject ink from said discharge port to perform a discharge recovery operation and (ii) a retracted position in which said pressing member is received by said receiving surface when not performing said discharge recovery operation, wherein said pressing member has a holding portion held by said printer body, and a body portion connected to said holding portion and capable of being extended and retracted and said holding portion has a cylindrical shape or a polygonal column shape, and a recess portion is formed at a contacting surface between said holding portion and said receiving surface, and wherein said pressing member is received with a click between said recovery position and said retracted position by engaging said holding portion with said recess portion.

5. An ink jet printer having a printer body, the printer comprising:

a mounting section for detachably mounting to the printer an ink jet recording head having an ink chamber with a deformable bladder for storing ink to be supplied to a discharge port for discharging ink therethrough;

recovery means on said printer body, said recovery means including a receiving surface and a pressing member for pressing said ink chamber, said pressing member being movable between (i) a recovery position in which said pressing member extends from said receiving surface in an orientation wherein said pressing member can be used to press said ink chamber and eject ink from said discharge port to perform a discharge recovery operation and (ii) a retracted position in which said pressing member is received by said receiving surface when not performing said discharge recovery operation, wherein said recovery means has a pair of engaging members for regulating the recovery position and the retracted position of said pressing member, wherein said pair of engaging members are provided on a route between said recovery position and said retracted position of said pressing member and comprise elastically deformable members which are separated from each other by a space narrower than a diameter of said pressing member, deform as said pressing member passes therethrough, and maintain and fix said pressing member upright at said recovery position.

6. A recovery device for an ink jet recording head, comprising:

a receiving surface;

a pressing member for pressing an ink chamber of the ink jet recording head, said ink chamber having a deformable bladder for storing ink to be supplied to a discharge port for discharging ink therethrough, said pressing member being movable between (i) a recovery position in which said pressing member extends from said receiving surface in an orientation wherein said pressing member can be used to press said ink chamber and eject ink from said discharge port to perform a discharge recovery operation and (ii) a retracted position in which said pressing member is received by said receiving surface when not performing said discharge recovery operation, wherein said pressing member has a holding portion held by said printer body and a body portion connected to said holding portion and capable of being extended and retracted, and wherein said holding portion has a cylindrical shape or a polygonal column shape, and a recess portion is formed at a contacting surface between said holding portion and said receiving surface, and wherein said pressing member is received with a click between said recovery position and said retracted position by engaging said holding portion with said recess portion.

7. A recovery device for an ink jet recording head, comprising:

a receiving surface;

a pressing member for pressing an ink chamber of the ink jet recording head, said ink chamber having a deformable bladder for storing ink to be supplied to a discharge port for discharging ink therethrough, said pressing member being movable between (i) a recovery position in which said pressing member extends from said receiving surface in an orientation wherein said pressing member can be used to press said ink chamber and eject ink from said discharge port to perform a discharge recovery operation and (ii) a retracted position in which said pressing member is received by said receiving surface when not performing said discharge recovery operation; and a pair of engaging members for regulating the recovery position and the retracted position of said pressing member, wherein said pair of engaging members are provided on a route between said recovery position and said retracted position of said pressing member and comprise elastically deformable members which are separated from each other by a space narrower than a diameter of said pressing member, deform as said pressing member passes therethrough, and maintain and fix said pressing member upright at said recovery position.

* * * * *

UNITED STATES PATENT AND TRADEMARK OFFICE

CERTIFICATE OF CORRECTION

PATENT NO. : 4,967,209

DATED : October 30, 1990

INVENTOR(S) : TAKESHI HASEGAWA, ET AL.

It is certified that error appears in the above-identified patent and that said Letters Patent is hereby corrected as shown below:

COLUMN 2

Line 44, "reguirements" should read --requirements--.
Line 66, "vide" should read --vide a--.

COLUMN 6

Line 37, "down" should be deleted.

COLUMN 7

Line 23, "receiving surface" should read --said receiving surface--.

Signed and Sealed this

Twenty-third Day of April, 1991

*Attest:*

*Attesting Officer*

HARRY F. MANBECK, JR.

*Commissioner of Patents and Trademarks*